United States Patent [19]

Hetrick

[11] 4,236,329

[45] Dec. 2, 1980

[54] DETACHABLE BLADE MOUNTING DEVICE

[75] Inventor: Vernon L. Hetrick, North Olmsted, Ohio

[73] Assignee: Meyer Products, Inc., Cleveland, Ohio

[21] Appl. No.: 56,823

[22] Filed: Jul. 12, 1979

[51] Int. Cl.[3] ..... E01H 5/08; A01B 51/00

[52] U.S. Cl. ..... 37/42 R; 172/273; 280/479 R; 414/723; 403/15

[58] Field of Search ..... 37/41, 42 R, 50, 44; 172/273, 272, 275; 280/479 R, 481; 403/15, 31, DIG. 4; 414/686, 723

[56] References Cited

U.S. PATENT DOCUMENTS

| | | | |
|---|---|---|---|
| 3,285,625 | 11/1966 | Krueger | 280/479 R |
| 3,410,008 | 11/1968 | Standfuss | 37/42 R |
| 3,432,949 | 3/1969 | Glesmann | 37/44 |
| 3,483,641 | 12/1969 | Hirt | 37/44 |
| 3,528,685 | 9/1970 | Eastman | 280/479 R |
| 3,760,883 | 9/1973 | Birk | 172/273 |
| 3,851,894 | 12/1974 | Pierre | 37/42 R X |
| 3,876,092 | 4/1975 | MacDonald | 414/686 |
| 3,987,562 | 10/1976 | Deen et al. | 37/42 R |
| 4,013,182 | 3/1977 | Pratt et al. | 414/723 |
| 4,068,959 | 1/1978 | Pemberton | 403/15 |

*Primary Examiner*—E. H. Eickholt

*Attorney, Agent, or Firm*—Meyer, Tilberry & Body

[57] ABSTRACT

A snow plow is detachably mounted to the front of a vehicle by interlocking members extending from the snow plow and vehicle. Engageable members on the plow are fixedly positioned a predetermined distance apart. Corresponding engaging members on the vehicle are displaceable between latching and unlatching positions by an over-center linkage arrangement. A first portion of the over-center linkage is pivotally connected to the vehicle. A second portion of the over-center linkage is slidably connected to the vehicle. Actuation of a hydraulic cylinder forces the over-center linkage to move from the unlatching position, wherein the blade and vehicle are disconnected, to the latching position, wherein the blade and vehicle are detachably connected. With the over-center linkage in the latching position, a toggle pin at the center moves against an abutment to lock the position of the over-center linkage, and therefore the plow onto the vehicle.

19 Claims, 6 Drawing Figures

DETACHABLE BLADE MOUNTING DEVICE

BACKGROUND OF THE INVENTION

The present invention relates to plow blades mounted on the front of vehicles and, more particularly, to a method and apparatus for detachably mounting a plow blade to the front of a vehicle. Specifically, the invention is concerned with a mechanical latching arrangement of a plow blade to a vehicle through hydraulic actuation.

At present, the most commonly used arrangement for attaching a plow blade to a vehicle involves pivotally connecting an A-frame which supports the blade to a frame extension below the front of the vehicle. Vertical displacement of the blade and A-frame is provided by a hydraulic cylinder, lift arm and chain arrangement mounted above the vehicle frame. When the hydraulic cylinder is extended, the lift arm is elevated and the chain lifts the blade from the roadway. To attach the blade to the vehicle, the A-frame must be aligned with the frame extension below the front of the vehicle. This alignment comprises both lateral and vertical alignment and is time consuming and most often accomplished only with considerable manual effort, such as physically lifting and moving the plow blade. The chain is then connected from the A-frame to the lift arm. Once the A-frame and frame extension have been aligned, locking pins connect the A-frame and allow for pivotal movement of the A-frame and thus the blade relative to the vehicle.

Vehicles used for operating plow blades are generally intended to be multi-purpose vehicles. Thus, it is imperative in such cases that the plow blade be detachable for use of the vehicle without the plow. Obviously, the time and manual effort involved in connecting and disconnecting a plow blade to a vehicle is increased by the presence of inclement weather conditions, such as snow and ice, as is the safety and comfort of a person or persons doing the work. For these reasons, it is desirable to minimize the manual effort and time required to attach and/or detach the blade from the vehicle, as well as the exposure of an individual to inclement conditions while doing so.

Many efforts have been made heretofore to improve the detachability of plow blades, including the use of mechanically actuated latching devices for attaching a blade to a vehicle. In connection with such arrangements, the vehicle is moved towards the blade such that corresponding mating members on the vehicle frame and the plow blade releasably latch when proper alignment of the blade and vehicle has been obtained. Alignment of the vehicle relative to the plow blade unit poses significant problems in many of these devices since the mechanical latching devices are relatively small. When it is desired to remove the blade from the vehicle, an operator must physically disengage the latching mechanism while the vehicle and plow are being separated. Examples of these arrangements are shown in U.S. Pat. Nos. 3,285,625; 3,410,008; 3,851,894; and, 3,987,562.

Another approach at providing a detachable vehicle mounted blade involves use of a hydraulic blade lift unit which is mounted on, and detachable with, a blade assembly. Attachment of the blade assembly to the vehicle is accomplished by moving the vehicle into alignment with the plow blade assembly and then connecting the hydraulic lift unit on the blade assembly to the vehicle hydraulic system. The vehicle is then moved into contact with the plow blade assembly, assuming lateral alignment has been obtained, and the blade assembly is lifted onto the vehicle by actuating the hydraulic lift unit. Examples of systems employing such an arrangement are shown in U.S. Pat. Nos. 3,432,949 and 3,483,641. These arrangements merely provide for lifting the blade assembly onto the vehicle, and additional operations are necessary to assure locking of the blade assembly to the vehicle, such as hand actuation of mechanical linkage or bolts.

Various arrangements of hydraulic clamping mechanisms have also been utilized to latch a blade to a vehicle. One such arrangement includes relatively displaceable interengaging clamping components and a piston-cylinder unit in which the piston is extended to cause interengagement therebetween and to hold the components in interengagement. Examples of this type of mechanism are shown in U.S. Pat. Nos. 3,876,092; 4,013,182; and, 4,068,959. These devices present operational difficulties in the event that hydraulic pressure is lost. In this respect, loss of pressure causes the piston to retract and thus the holding force to be released. In another example, the piston-cylinder operation is reversed such that retraction of the piston causes the latching of a blade unit to the vehicle. This type of system is examplified by devices disclosed in U.S. Pat. Nos. 3,528,685 and 3,760,883. Neither of these devices are suitable for plow blades in that the jolting forces exerted on the blade unit can cause disengagement of the latching mechanisms. In this respect, sudden upward movement of the blade unit can overcome a spring biased clamping arrangement in one instance, and abrupt abutment of the blade unit with a stationary object can cause shearing of locking pins in the other instance.

SUMMARY OF THE INVENTION

The present invention provides a hydraulically operated blade mounting device which advantageously minimizes the physical efforts of an operator in achieving attachment or detachment of a blade from a vehicle, avoids exposing the operator to possible injury and to adverse weather conditions, and assures the continued application of latching force in the event of failure in the hydraulic system. More particularly, in accordance with the invention, the blade mounting device provides hydraulic actuation of a mechanical latching mechanism to obtain secure mounting of a blade unit to a vehicle. The device enables the operator to align the vehicle relative to the blade unit and achieve attachment of the blade unit to the vehicle without either leaving the vehicle or obtaining assistance from other personnel. In this respect, the blade unit is provided with fixed latching components and the vehicle is provided with movable latching components adapted to be hydraulically actuated by the operator from within the cab of the vehicle. With the blade unit detached and resting on the ground, the operator manipulates the vehicle to position the latching components for interengagement. The operator then manipulates hydraulic controls within the cab, whereby the hydraulically operated latching components on the vehicle lift the blade unit from the ground position, and mechanically latch the blade unit securely to the vehicle against detachment in the event of failure of or in the hydraulic system.

In accordance with the preferred embodiment, the movable latching components provided on the vehicle include an over-center linkage arrangement which locks the blade unit to the vehicle against detachment in the event of subsequent inoperativeness of the hydraulic system.

A primary object of the present invention is to provide an improved hydraulically actuated blade mounting device.

Another object of the present invention is to provide an improved plow blade mounting device which does not require an operator of a vehicle to leave the vehicle or obtain assistance in aligning a plow blade unit to the vehicle and connecting and/or disconnecting the blade unit from the vehicle.

Yet another object of the present invention is to provide an improved plow blade mounting device which does not subject an operator to inclement weather conditions or unsafe situations while connecting or disconnecting a plow blade unit from a vehicle.

A further object is the provision of an improved hydraulically actuated blade mounting device enabling attachment and detachment of a blade unit relative to a vehicle to be achieved safely, and efficiently with respect to time, without manual part manipulation, and with positive mechanical blade unit retention independent of the hydraulic actuating system.

Still another object of the present invention is to provide an improved hydraulically operated plow blade mounting device which includes fixed latching components on a blade unit and displacable latching components on a vehicle cooperable to effect interlocking of the blade unit to the vehicle to assure against detachment even in the event of loss of hydraulic pressure subsequent to connection of the blade unit to the vehicle.

BRIEF DESCRIPTION OF THE DRAWINGS

The invention may take physical form in a variety of parts and arrangements of parts, a preferred embodiment of which will be described in the following specification and is illustrated in the accompanying drawings which form a part hereof and wherein.

PREFERRED EMBODIMENT

Figure 1:
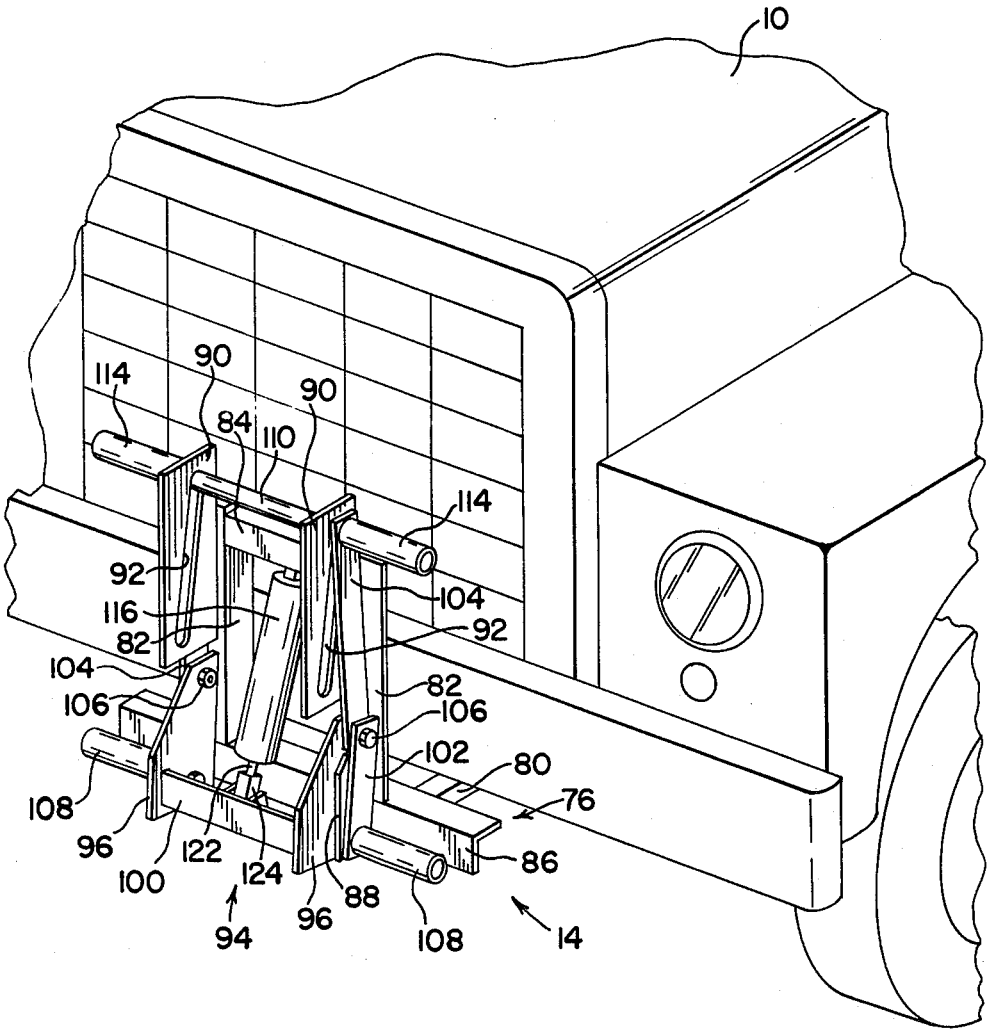
FIG. 1 is a partial pictorial view illustrating a vehicle equipped with a vehicle portion of a blade mounting device constructed in accordance with the present invention.
Figure 2:
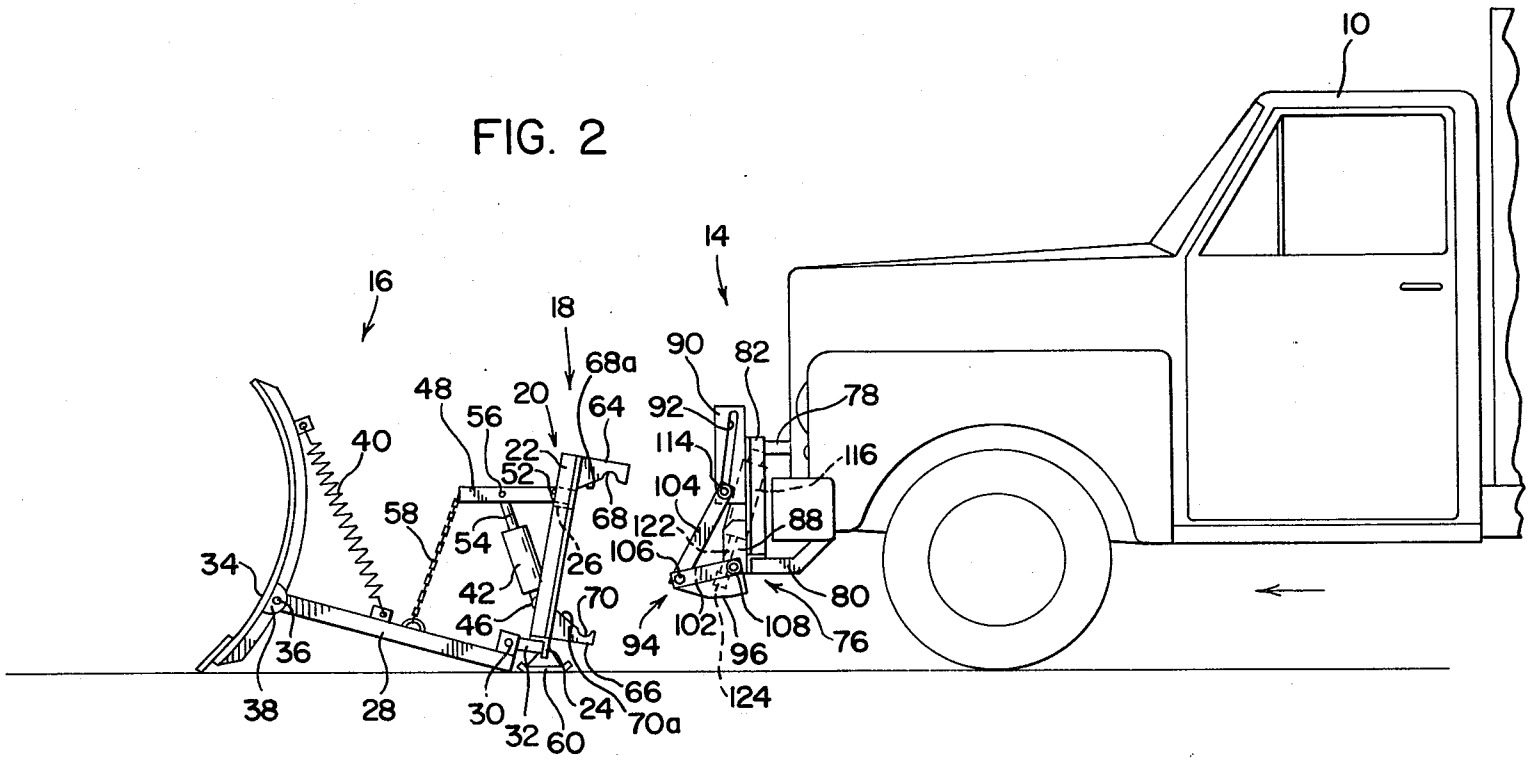
FIG. 2 is a side elevation view of the vehicle and the vehicle portion of the blade mounting device, and a plow blade assembly including a plow blade portion of the mounting device, depicting the vehicle and blade portion disconnected.

Referring now to the drawings wherein the showings are for the purpose of illustrating a preferred embodiment of the invention only and not for the purposes of limiting the same, FIG. 1 shows a vehicle 10 having a vehicle portion 14 of a blade mounting device mounted on the front of vehicle 10, and FIG. 2 shows a snow plow blade assembly, generally indicated at reference numeral 16, having a plow blade portion 18 of the blade mounting device thereon. It is preferred that the blade assembly have a downward sloping orientation in the direction of the vehicle, as shown in FIG. 2, to facilitate attachment of blade assembly 16 to vehicle 10. Plow blade portion 18 of the mounting device, as best seen in FIGS. 2, 3, 4 and 6, includes a frame assembly 20 composed of a pair of laterally spaced apart, upright frame members 22 interconnected at their lower ends by a lower cross-member 24 and near their upper ends by an upper cross-member 26. One end of each leg 28 of an A-frame, only one of which legs is shown, is pivotally connected as by a pin or bolt 30 to frame assembly 20 by means of a corresponding one of a pair of brackets 32. Brackets 32 extend from lower cross-member 24 and each bracket is near the lower end of a corresponding one of the upright frame members 22. The other end of each leg 28 of the A-frame is pivotally interconnected with a snow plow blade 34 by means of a pin 36 and a corresponding bracket 38 on the blade. As is customarily provided in plow blades, a tension spring 40 is provided between legs 28 of the A-frame and snow plow blade 34 to return the snow plow blade to an upright position in the event that the blade is caused to tilt forward by an obstruction in the roadway.

A hydraulic cylinder device 42 is centrally located within frame assembly 20. Lower cross-member 24 supports hydraulic cylinder device 42 by means of a pin 44 extending through a mounting flange on the cylinder device and a bracket 46 permanently secured to the lower cross-member. Upper cross-member 26 supports a lift arm 48 which is pivotally connected thereto by means of a pin 50 and a pair of brackets 52 permanently secured to the upper cross-member. Hydraulic cylinder 42 includes an extendable piston rod 54 having its outer end connected to lift arm 48 generally at the center thereof by a pin or bolt 56. A link chain 58 is connected between the outer end of lift arm 48 and legs 28 of the A-frame. When hydraulic cylinder 42 is operated to extend rod 54, lift arm 48 pivots about pin 50 causing chain 58 to raise snow plow blade 34 from the roadway. Retraction of the piston rod results in lowering of lift arm 48 and the plow blade. Such movement of the plow blade occurs as pivotal motion about pins 30.

Each upright frame member 22 has an upper bracket 64 extending generally perpendicularly from near the upper edge of the frame member in a direction away from the plow blade assembly. Upper brackets 64 are permanently secured to the upright frame members, as by welding. Also extending generally perpendicularly from near the lower edge of each upright frame member 22 is a lower bracket 66. Lower brackets 66 are likewise permanently secured to the upright frame members, as by welding. Each upper bracket 64 has a recess providing a generally downwardly facing concave surface 68. Each lower bracket 66 has a recess providing a generally upwardly facing concave surface 70. Downwardly facing concave surfaces 68 and upwardly facing concave surfaces 70 are spaced apart in vertically opposed relationship and are separated by a predetermined distance. Upper brackets 64 on upright frame members 22 are each provided with an angled gusset 72 permanently secured between the bracket and the upright frame member, as by welding. As set forth more fully hereinafter, these angled gussets 72 assist in aligning snow plow blade assembly 16 relative to vehicle 10 in the event that lateral alignment of blade assembly 16 and vehicle 10 is not precise during a mounting operation.

As seen in FIGS. 1–6, vehicle portion 14 of the blade mounting device includes a frame assembly 76 which is secured to vehicle 10 by upper mounting members 78 and lower mounting members 80. Mounting members 78 and 80 are preferably permanently secured to frame assembly 76, as by welding, and are releaseably secured to the vehicle frame, as by bolting. Frame assembly 76 comprises a pair of upright, laterally spaced apart frame members 82 interconnected at their upper edges by a top cross-member 84 and at their lower edges by a bottom cross-member 86. Upright frame members 82, and top and bottom cross-members 84 and 86 are preferably welded together. Welded to the bottom edge of each upright frame member 82 and forwardly perpendicular thereto is a pivot plate 88, best shown in FIGS. 3, 5, and 6. Also welded to each upright frame member 82, toward the upper edges thereof and forwardly perpendicular thereto, is a slide plate 90. Slide plates 90 are rectangular in shape with the longer dimension thereof parallel to member 82, and each plate includes a diagonal elongated aperture 92 extending from the upper corner nearest frame member 82 to the lower corner furthest from frame member 82, best shown in FIGS. 1 and 3.

Figure 5:
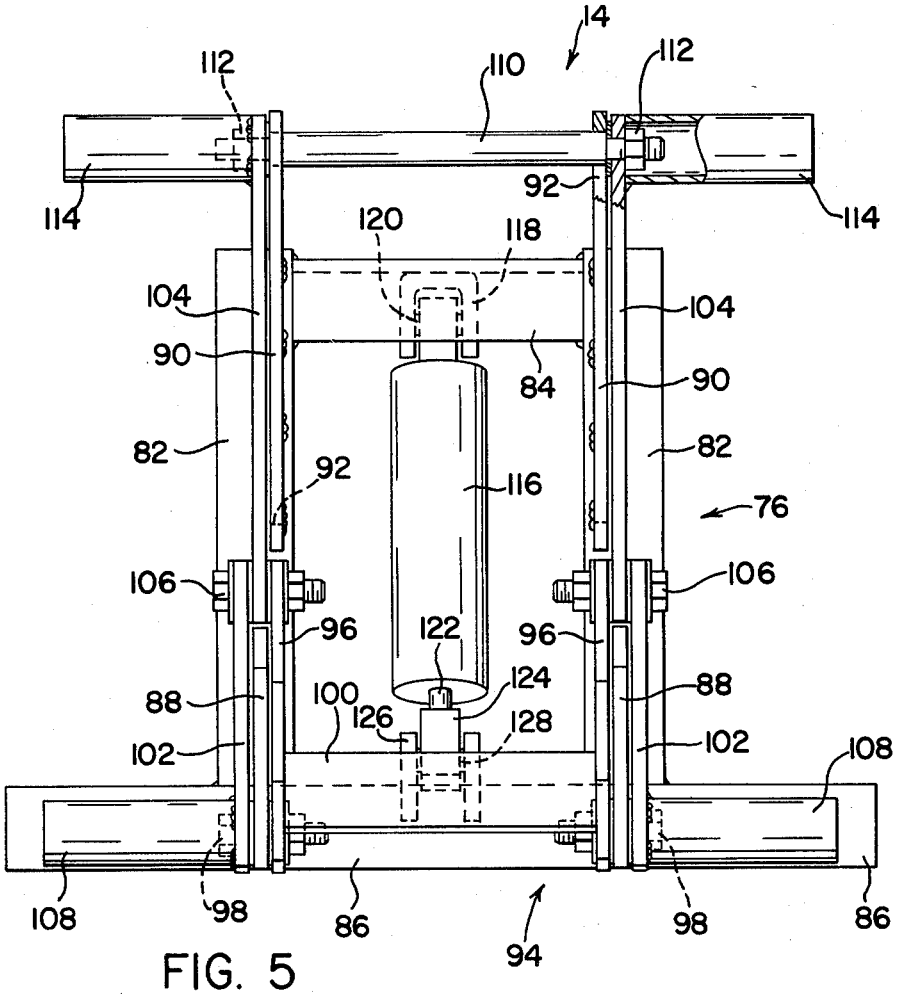
FIG. 5 is a front elevation view taken along line 5—5 of FIG. 4 and illustrating the vehicle portion of the blade mounting device.

Latching linkage assemblies, indicated generally by reference numeral 94, are mounted on frame assembly 76 for movement relative thereto. Each latching linkage assembly includes a support plate 96 parallel to a corresponding one of the pivot plates 88 and connected thereto by a bolt 98 (FIG. 5). Support plates 96 of latching linkage assemblies 94 are permanently connected together by a support cross-member 100 as by welding at the lower front corners. Each latching linkage 94 also includes an over-center linkage arrangement composed of a lower link 102, an upper link 104 and a toggle pin 106, best shown in FIGS. 1 and 5. One end of lower link 102 is pivotally connected with pivot plate 88 and support plate 96 by bolt 98. Each lower link 102 supports a first cylindrical tube 108 which is perpendicular thereto. First tubes 108 are permanently attached to lower links 102 as by welding and extend in laterally opposite directions as seen in FIG. 5. The diameter of tubes 108 correspond with the contour of upwardly facing concave surfaces 70 on frame assembly 20. Support plate 96, at its upper end, and lower link 102 at its other end, are pivotally connected at toggle pin 106. One end of upper link 104 is also connected at toggle pin 106 to the support plate and the lower link. Each of upper links 104 have their other ends connected to a rod member 110, as by nuts 112 secured to threaded end portions of the rod member, FIG. 5. Rod member 110 is arranged to extend through diagonal elongated aperture 92 at each end of the rod member and is capable of sliding movement relative to the diagonal aperture. Second circular tubes 114 are permanently secured to upper links 104, as by welding, in axially opposed directions from each end of the rod member, as shown in FIG. 5. The diameter of second tubes 114 corresponds with the contour of downwardly facing concave surface 68 on frame assembly 20.

Latching linkage 94 is effective to move second tubes 114 relative to frame assembly 76 between latching and unlatching positions. While one end of lower link 102 is pivotally movable about bolt 98, the upper end of upper link 104 is slidably movable along a path defined by diagonally elongated aperture 92. In this respect, elongated aperture 92 provides extreme lower and upper limits of slidable movement for rod member 110 and therefore second tubes 114 which are arranged to correspond with the unlatching and latching positions of latching linkage 94, respectively.

Figure 3:
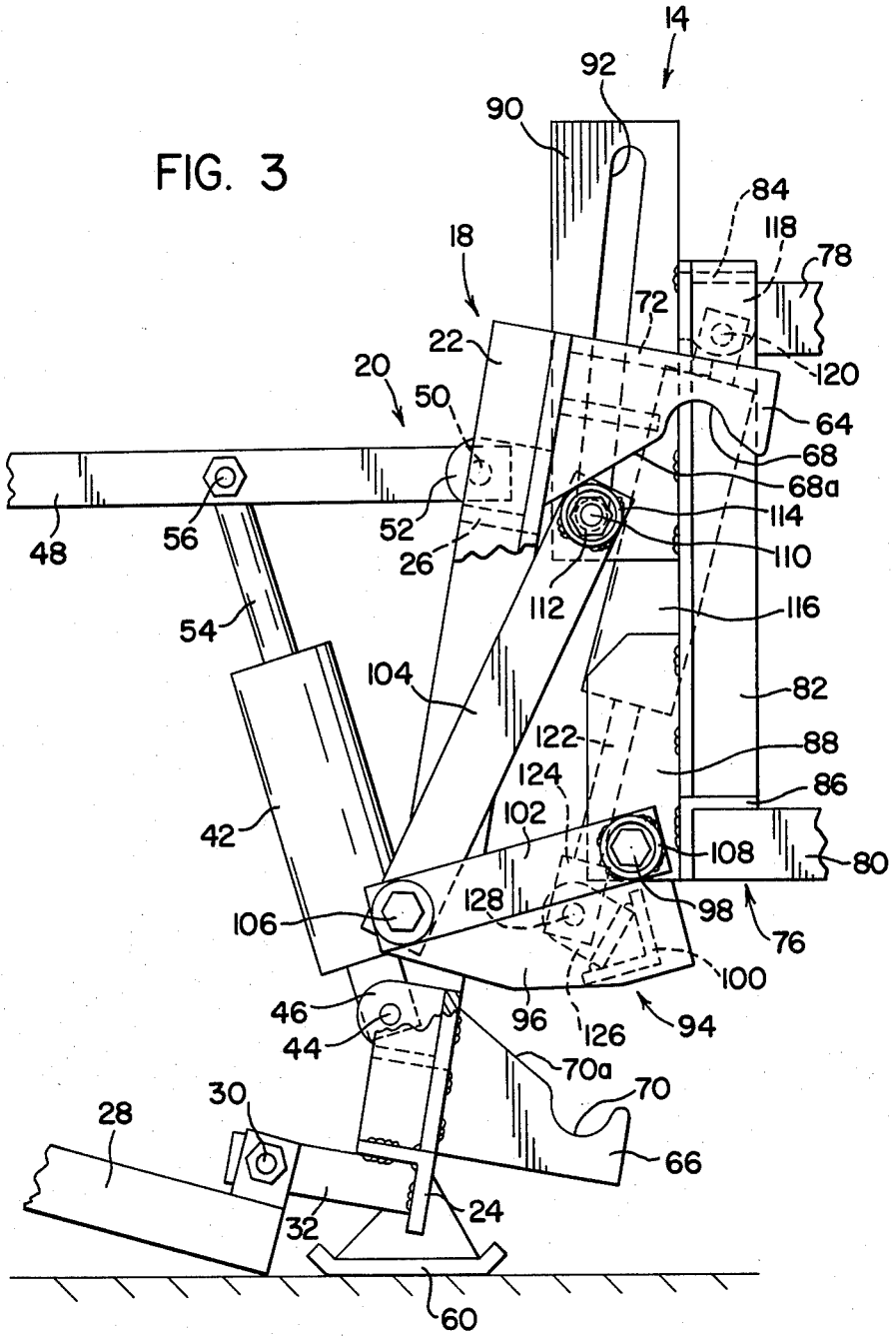
FIG. 3 is a detailed elevational view of the vehicle and plow blade portions of the blade mounting device during a stage of a mounting operation.

Movement of latching linkage 94 relative to frame assembly 76 occurs as a result of actuation of a hydraulic cylinder device 116 mounted between support cross-member 100 of the latching linkage and top cross-member 84 of the frame assembly, as shown in FIGS. 1, 3 and 5. A bracket 118 is permanently secured to top cross-member 84, as by welding, and hydraulic cylinder 116 is pivotally mounted at its upper end to this bracket by means of a pin or bolt 120. A ram member 122, extendable from hydraulic cylinder 116, has a mounting flange 124 at the free end thereof. A bracket 126 is permanently secured to support cross-member 100, as by welding, and flange 124 is pivotally connected thereto by means of a pin or bolt 128, best seen in FIGS. 3, 4 and 5. Hydraulic cylinder device 116 is a double acting cylinder capable of extending ram member 122 to move latching linkage 94 to the unlatched position, shown in FIG. 2, and retracting ram member 122 to move the latching linkage to the latched position, shown in FIGS. 1 and 4.

Figure 4:
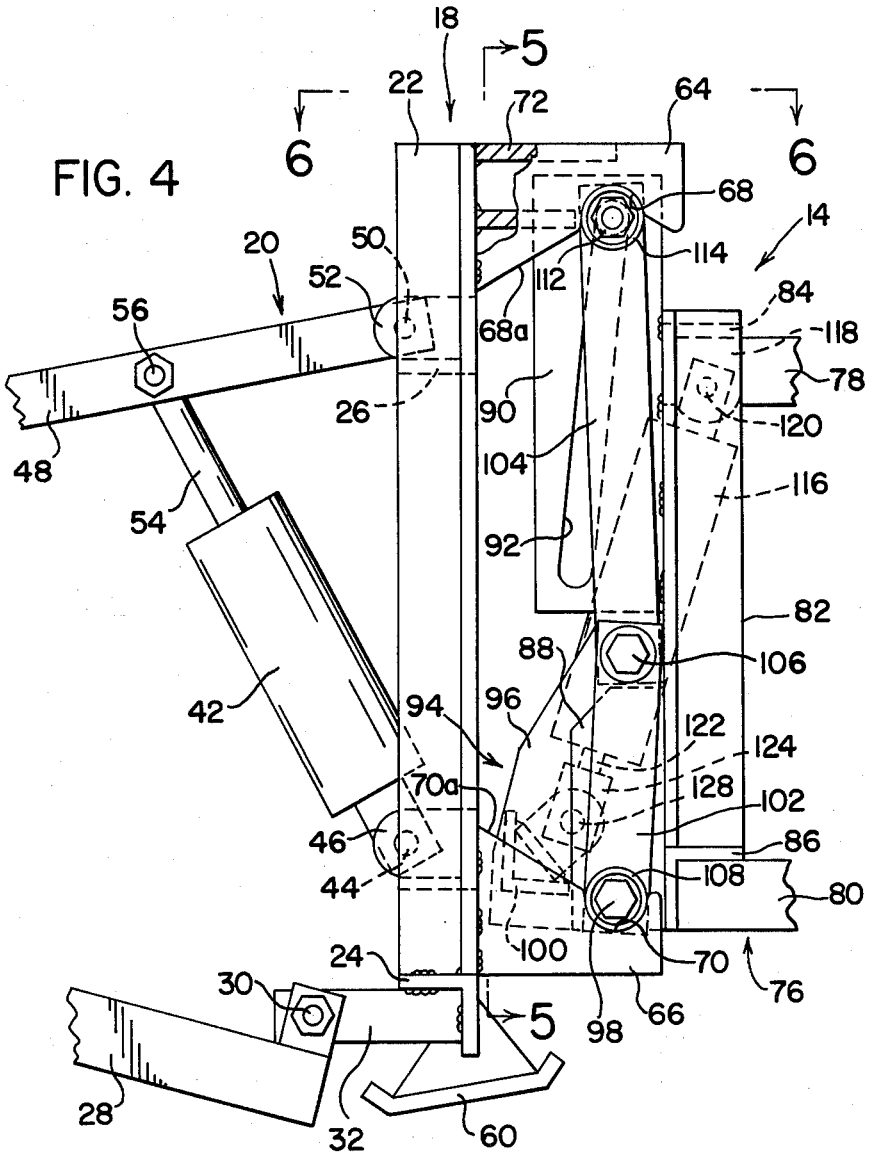
FIG. 4 is a side elevational view of the vehicle and plow blade portions of the blade mounting device when the blade is mounted on the vehicle.

As hydraulic cylinder device 116 extends ram member 122 from the position shown in FIG. 4, support plates 96 and toggle pins 106 attached thereto pivot outwardly about bolts 98. Such displacement of plates 96 and pins 106, pivots lower links 102 outwardly about bolts 98 and displaces upper links 104 outwardly and downwardly, whereby second tubes 114 move outwardly and downwardly along slots 92 and out of recesses 68 to the unlatched position, shown in FIG. 3. In the unlatched position, first tubes 108 and second tubes 114 are in vertical spaced relation separated by a distance substantially less than the distance between upper and lower recesses 68 and 70 on frame assembly 20. Further, each of the tubes 108 and 114 is vertically spaced from the corresponding recess, thus enabling free movement of vehicle 10 toward and away from the blade assembly. When hydraulic cylinder 116 retracts ram member 122 from the position shown in FIG. 3, support plates 96 and toggle pins 106 pivot upwardly about bolts 98, and links 104 are displaced upwardly whereby tubes 114 move upwardly and inwardly along slots 92 to the latched position, shown in FIG. 4. It is to be noted in particular, as seen in FIG. 4, that toggle pins 106 of the linkage 94 are in an over-center position with respect to a line through the axes of tubes 108 and 114 when tubes 114 have reached the latched position. Latched status is obtained when toggle pins 106 move past the line between tubes 108 and 114, and the ends of support plates 96 and links 102 and 104 defining the toggle joints with pins 106 engage and abut the corresponding frame member 82, as shown in FIG. 4, to maintain latched status independent of hydraulic cylinder 116.

Figure 6:
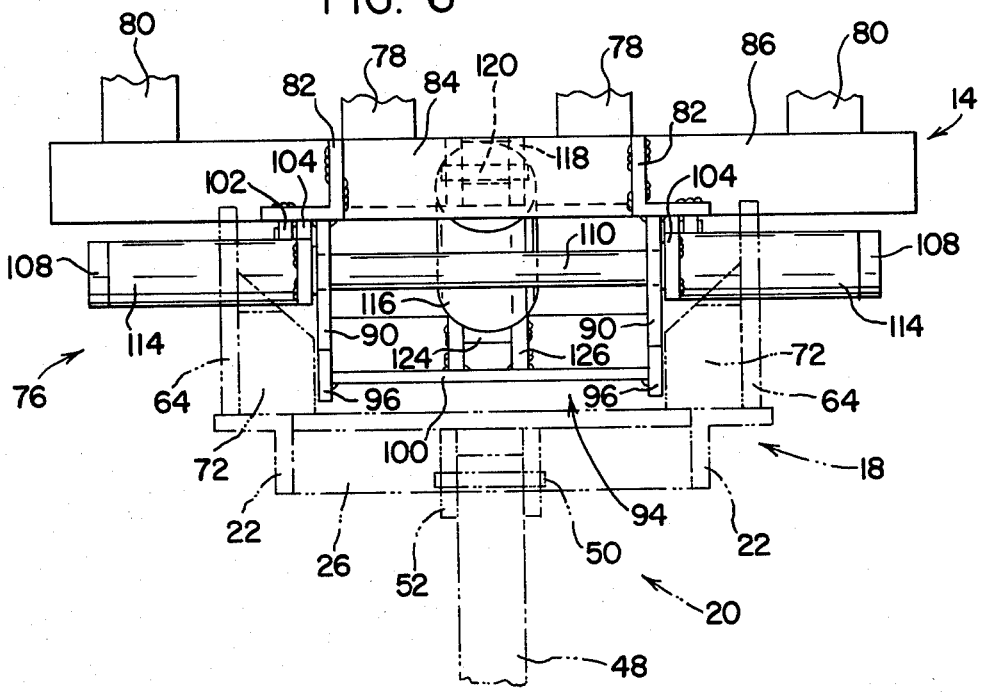
FIG. 6 is a plan view taken along line 6—6 of FIG. 4 and illustrating the vehicle and plow blade portions of the blade mounting device.

FIG. 1 illustrates latching linkage 94 in a storage position, corresponding to the latching position of the second tubes. This storage position is maintained when the blade mounting device is not in use to connect a snow plow blade assembly 16 to the front of vehicle 10. When the snow plow blade assembly 16 is to be attached to vehicle 10, latching linkage 94 is moved to the unlatched position by actuation of hydraulic cylinder 116 and extension of ram member 122 (FIG. 2). Alignment of vehicle 10 relative to snow plow blade assembly 16 is accomplished by an operator moving the vehicle towards the snow plow blade assembly while adjusting laterally by visual inspection. Angled gussets 72, noted above, assure accurate alignment once the operator has aligned the plow blade assembly to the vehicle as close as practically possible. More particularly, as the vehicle is moved toward the plow blade assembly, the operator is required to visually align the vehicle and blade assembly to the extent that slide plates 90 are within upper brackets 64. The distance between upper brackets 64 is purposely designed to be substantially larger than the distance between slide plates 90 so visual alignment is both possible and practical. At least one of angled gussets 72 engages a corresponding one of slide plates 90 as the vehicle continues to move toward the blade assembly. The blade assembly is forced to move in a transverse direction to the vehicle movement as a result of sliding contact between angled gusset 72 and slide plate 90. Finally, slide plates 90 move between straight walled portions of angled gussets 72, as best seen in FIG. 6, to complete alignment of the vehicle and blade assembly. Frame assembly 20 is designed to orient the snow plow blade assembly as shown in FIG. 2 with the frame assembly angled in the direction of the vehicle. Control of hydraulic cylinder 116 is provided from within the cab of vehicle 10 and is activated to position latching linkage 94 in the unlatching position, shown in FIG. 2, as vehicle 10 is driven toward the snow plow blade assembly.

When vehicle 10 has moved completely forward into engagement with snow plow blade assembly 16, second tubes 114 contact the upper bracket 64. An operator retracts ram member 122 within hydraulic cylinder 116 from within the cab of vehicle 10. Second tubes 114 move upwardly, along the path of diagonal elongated apertures 92, maintaining contact with edge 68*a* of upper brackets 64, as the ram member is retracted. Sliding movement occurs between second tubes 114 and upper bracket 64 until the cylindrical second tubes engage downwardly facing concave surfaces 68. Further retraction of ram member 122 causes frame assembly 20 to be lifted by second tubes 114 until the latching position is reached along the path of diagonal elongated apertures 92.

While second tubes 114 are approaching the latching position, the bottom of frame assembly 20 tilts inward towards the vehicle causing the edges 70*a* of lower brackets 66 to contact first tubes 108. First tubes 108 are guided along edges 70*a* of lower brackets 66 and into upwardly facing concave surfaces 70, as second tubes 114 continue to rise toward the latching position. First and second tubes, 108 and 114, are locked into upwardly facing concave surfaces 70 and downwardly facing concave surfaces 68, respectively, when the second tubes have moved completely into the latched position. Abutting contact of the toggle joints with upright frame members 82, as shown in FIG. 4, locks frame assembly 20 and frame assembly 76 together, as described hereinabove.

Detachment of snow plow blade assembly 16 from vehicle 10 is likewise possible from within the cab of the vehicle. Snow plow blade 34 is first lowered to the roadway. Hydraulic cylinder 116 is then actuated to extend ram member 122 causing latching linkage 94 to move relative to frame assembly 76. Second tubes 114 begin moving downwardly and outwardly which results in first tubes 108 becoming disengaged from upwardly facing concave surfaces 70 on frame assembly 20, as the latching linkage moves. Continued extension of ram member 122 results in frame assembly 20 being lowered so as to be supported solely by the roadway and then movement of second tubes 114 out of engagement with downwardly facing concave surfaces 68 on frame assembly 20. When latching linkage 94 reaches the unlatched position, the vehicle is separated from the snow plow blade assembly and the vehicle may be driven away from the blade assembly.

Hydraulic cylinder device 42 is supported on frame assembly 20 and, once the snow plow blade assembly has been connected to the vehicle, hydraulic cylinder 42 must be connected to the system within vehicle 10. The connection of hydraulic cylinder device 42 may be accomplished by interconnection of hydraulic fluid lines or electrical connections, depending upon the particular design of the hydraulic system used to operate snow plow blade assembly 16. Further, hydraulic cylinders may be arranged on snow plow blade assembly 16 for the purposes of angling snow plow blade 34 horizontally relative to the A-frame. Hydraulic cylinder device 42 must also be disconnected when the snow plow blade assembly is disengaged from the vehicle. It is to be noted, however, that such connection of the hydraulic or electric lines is completely independent of the blade assembly attaching and detaching operations.

While considerable emphasis has been placed herein on preferred embodiments of the invention and the specific structures and structural interrelationships of the component parts thereof, it will be readily apparent that many embodiments of the invention can be made, and that many changes can be made in the embodiments herein illustrated and described without departing from the principles of the invention. Accordingly, it is to be distinctly understood that the foregoing descriptive matter is to be interpreted merely as illustrative of the invention and not as a limitation.

Having thus described the invention, the following is claimed:

1. A device for mounting a snow plow blade onto a vehicle comprising: first frame means for said snow plow blade, said first frame means having upper and lower latching surface means vertically spaced apart a fixed distance; second frame means on said vehicle, upper and lower latching member means on said second frame means corresponding respectively to said upper and lower latching surface means; means including toggle linkage means supporting one of said latching member means for displacement between latched and unlatched positions relative to said second frame means, said upper and lower latching member means in said unlatched position being spaced apart a distance less than said fixed distance and in said latched position engaging the corresponding latching surface means, said toggle linkage means having an over-center position with respect to said upper and lower latching member means when said one latching member means is in said latched position, means for moving said toggle linkage means to displace said one latching member means between said latched and unlatched positions, and means for maintaining said toggle linkage means in said over-center position when said one latching member means is displaced to said latched position.

2. The device according to claim 1 wherein said toggle linkage means includes over-center linkage having a lower link, an upper link, a toggle pin, and an abutment, said lower link being pivotally connected to said second frame means, said upper link being slidingly connected to said second frame means.

3. The device according to claim 2 wherein said lower link supports said lower latching member means, said upper link supports said upper latching member means, said upper link positioning said upper latching member means in spaced apart vertical relation from said lower latching means a distance substantially less than the fixed distance when said upper latching member means is in said latched position and in spaced apart vertical relation from said lower latching member means a distance substantially equal to the fixed distance with said upper latching member means in the latched position.

4. The device according to claim 3 wherein said upper and lower links are interconnected by said toggle pin, said abutment restrains further forward movement of said upper latching member means when said toggle pin has moved to said over-center position with said upper latching member means in said latched position.

5. The device according to claim 1 wherein movement means for moving said toggle linkage means includes a hydraulically operated double acting cylinder connected between said toggle linkage means and said second frame means, said unlatched position corresponding to a ram member of said cylinder being extended and said latched position corresponding to said ram member of said cylinder being retracted.

6. The device according to claim 4 wherein said lower link has a first end pivotally connected to said second frame means, said lower link has a second end pivotally connected to said toggle pin, said lower latching member means being supported from said first end of said lower link, said upper link having a first end pivotally connected to said toggle pin, said upper link having a second end slidingly connected to said second frame means, said upper latching member means supported from said second end of said upper link.

7. The device according to claim 1 wherein said toggle linkage means includes a first over-center linkage positioned adjacent one side edge of said second frame means and a second over-center linkage positioned adjacent the other side edge of said second frame means.

8. The device according to claim 7 wherein said first and second over-center linkages each include a lower link, an upper link, a toggle pin, and an abutment, said lower link being pivotally connected to said second frame means, said upper link being slidingly connected to said second frame member.

9. The device according to claim 4 wherein said toggle linkage means includes a first over-center linkage positioned adjacent one side edge of said second frame means and a second over-center linkage positioned adjacent the other side edge of said second frame means.

10. The device according to claim 6 wherein said toggle linkage means includes a first over-center linkage positioned adjacent one side edge of said second frame means, a second over-center linkage positioned adjacent the other side edge of said second frame means, one of said upper latching means being supported by each of said second end of said upper links of said first and second over-center linkages, said abutment restraining said upper and lower links of said first and second over-center linkages.

11. The device according to claim 7 wherein said second frame means includes guide means for directing the sliding of second end of said upper links of said first and second over-center linkages relative to said second frame means, said guide means providing a lower limit of sliding movement corresponding to said unlatched position of said first and second over-center linkages and an upper limit of sliding movement corresponding to said latched position of said first and second over-center linkages.

12. A device for detachably mounting a snow plow onto a vehicle, first frame means for supporting said snow plow, a first pair of engageable means for connecting said snow plow to said vehicle supported near a bottom edge of said first frame means in a first horizontal plane, a second pair of engageable means for connecting said snow plow to said vehicle supported near a top edge of said first frame means in a second horizontal plane, said first and second horizontal planes separated by a predetermined distance, second frame means secured to said vehicle for releasably supporting said snow plow, linkage means supported by said second frame means for movement relative to said second frame means, a first pair of engaging means for connecting said snow plow to said vehicle supported by said linkage means, a second pair of engaging means for connecting said snow plow to said vehicle supported by said linkage means, movement means for moving said linkage means relative to said second frame means between an unlatched position wherein said first and second pairs of engaging means are separated by a distance substantially less than said predetermined distance and a latched position wherein said first and second pairs of engaging means are separated by a distance substantially equal to said predetermined distance, said linkage means including over-center linkage means for locking said snow plow to said vehicle, said over-center linkage means having a first link pivotally connected to said second frame means and supporting said first pair of engaging means, a second link slidably connected to said second frame means and supporting said second pair of engaging means, a toggle pin connecting said first and second links and an abutment restricting movement of said first and second links, whereby said first and second pairs of engaging means are positionable between said first and second pairs of engageable means when said linkage means is moved to said unlatched position and said first and said second pairs of engaging means are latchingly engaged with said first and second pairs of engageable means when said linkage means is moved to said unlatched position where said first and second links are restricted by said abutment.

13. The device according to claim 12 wherein said first frame means includes hydraulically actuated movement means for positioning said snow plow relative to said first frame means when said first frame means is latchingly engaged with said second frame means.

14. The device according to claim 12 wherein said linkage means includes a first over-center linkage means positioned adjacent one side edge of said second frame means and a second over-center linkage means positioned adjacent the other side edge of said second frame means.

15. The device according to claim 14 wherein one of said first pair of engaging means is supported by said first link of each of said first and second over-center linkage means, one of said second pair of engaging means is supported by said second link of each of said first and second over-center linkage means and said abutment of each said over-center linkage means restraining said first and second links.

16. The device according to claim 15 wherein said second frame means includes guide means for directing the sliding of said second links of said first and second over-center linkage means relative to said second frame means, said guide means providing a lower limit of sliding movement corresponding to said unlatched position of said first and second over-center linkage means and an upper limit of sliding movement corresponding to said latched position of said first and second over-center linkage means.

17. The device according to claim 12 wherein said movement means for moving said linkage means includes a hydraulically operated double acting cylinder connected between said linkage means and said second frame means, said unlatched position corresponding to a ram member of said cylinder being extended and said latched position corresponding to the ram member of said cylinder being retracted.

18. The device according to claim 12 wherein one of said first and second frame means includes bracket means for laterally aligning said first frame means relative to said second frame means as said vehicle moves toward said snow plow.

19. The device according to claim 18 wherein said bracket means is permanently secured to said first frame means.

* * * * *

UNITED STATES PATENT AND TRADEMARK OFFICE

CERTIFICATE OF CORRECTION

PATENT NO. : 4,236,329

DATED : December 2, 1980

INVENTOR(S) : Vernon L. Hetrick

It is certified that error appears in the above-identified patent and that said Letters Patent are hereby corrected as shown below:

Column 3, line 52, "portion" should read --portions--. Column 9, line 11, "latched" should read --unlatched--. Column 10, line 48, "unlatched" should read --latched--.

Signed and Sealed this

*Twelfth* Day of *May 1981*

[SEAL]

*Attest:*

RENE D. TEGTMEYER

*Attesting Officer*

*Acting Commissioner of Patents and Trademarks*